US008928707B2

(12) United States Patent
Zhang

(10) Patent No.: US 8,928,707 B2
(45) Date of Patent: Jan. 6, 2015

(54) LIQUID CRYSTAL DISPLAY DEVICE AND DRIVING METHOD THEREOF

(75) Inventor: Xin Zhang, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 329 days.

(21) Appl. No.: 13/378,270

(22) PCT Filed: Oct. 9, 2011

(86) PCT No.: PCT/CN2011/080583

§ 371 (c)(1),
(2), (4) Date: Dec. 14, 2011

(87) PCT Pub. No.: WO2013/044527

PCT Pub. Date: Apr. 4, 2013

(65) Prior Publication Data

US 2013/0076808 A1 Mar. 28, 2013

(30) Foreign Application Priority Data

Sep. 27, 2011 (CN) ..... 2011 1 0297729

(51) Int. Cl.
*G09G 3/36* (2006.01)
*G09G 5/02* (2006.01)

(52) U.S. Cl.
CPC ..... *G09G 3/3659* (2013.01); *G09G 3/3677* (2013.01); *G09G 2300/0426* (2013.01); *G09G 2300/0443* (2013.01); *G09G 2300/0814* (2013.01); *G09G 2310/0251* (2013.01); *G09G 2310/0283* (2013.01); *G09G 2310/0286* (2013.01)
USPC ..... 345/694; 345/89

(58) Field of Classification Search
CPC ..... G09G 3/3607
USPC ..... 345/694, 89
See application file for complete search history.

(56) References Cited

U.S. PATENT DOCUMENTS

2009/0086116 A1* 4/2009 Pak ..... 349/38
2011/0115998 A1* 5/2011 Liao et al. ..... 349/38

* cited by examiner

*Primary Examiner* — Amare Mengistu
*Assistant Examiner* — Sarvesh J Nadkarni
(74) *Attorney, Agent, or Firm* — Mark M. Friedman

(57) ABSTRACT

The present invention involves in an LCD device, which comprises a scan driving module, a data driving module, pixels, data lines, shift register modules and scan lines, the scan lines include type 1 scan lines, each of which is connected with the scan driving module and the pixel for controlling charging time of the pixel according to a first scan signal and type 2 scan lines, each of which is connected with the shift register module and the pixel for controlling driving time for sub-pixels of the pixel. The present invention further involves in an LCD device driving method. The LCD device and the driving method of the present invention can realize reverse scanning without increasing device costs, thereby solving a technical problem that a current LCD device fails to maintain proper driving effects when utilizing reverse scan driving.

7 Claims, 5 Drawing Sheets

LIQUID CRYSTAL DISPLAY DEVICE AND DRIVING METHOD THEREOF

TECHNICAL FIELD OF THE INVENTION

The present invention relates to a field of liquid crystal display (LCD), and more particularly, to an LCD device and a driving method thereof.

BACKGROUND OF THE INVENTION

A current LCD device generally utilizes a connection scheme between scan lines and pixels as shown in FIG. 1 to execute driving, FIG. 2 is a waveform diagram of driving signals for the scan lines shown in FIG. 1. As shown in FIG. 1, each pixel is connected to one scan line (e.g. GATE_N, GATE_N+1, GATE_N+2), the driving waveforms for the scan lines are shown in FIG. 2, the scan lines are switched on sequentially, a pulse width for each scan line is about 10-20 μs.

When the LCD device has a multi-domain design, the connection scheme between the scan lines and pixels is shown in FIG. 3, each pixel in the drawing is connected to two scan lines, one of the scan lines, which is referred to as a type 1 scan line, e.g. GATE_N, GATE_N+1, GATE_N+2, controls a voltage for charging the pixel; and the other scan line, which is referred to as a type 2 scan line, e.g. SHARING_N, SHARING_N+1, SHARING_N+2, controls charge sharing between sub-pixels of the pixel. In the drawing, the type 1 scan line is the $n^{th}$ scan line (e.g. GATE_N), and the type 2 scan line is the $n+1^{th}$ scan line (e.g. SHARING_N), wherein SHARING_N is the next scan line with respect to GATE_N.

FIG. 4 shows a modification of the connection scheme between the scan lines and pixels shown in FIG. 3, the difference is that the type 1 scan line is the $n^{th}$ scan line (e.g. GATE_N), and the type 2 scan line is the $n+2^{th}$ scan line (e.g. SHARING_N), wherein SHARING_N is the second scan line with respect to GATE_N. The rest can be deduced accordingly, the type 2 scan line can also be the $n+m^{th}$ scan line (m is a positive integer greater than 2).

FIG. 5 shows a driving waveform diagram for the scan lines of the LCD device having the multi-domain design. As can be observed from the drawing, the type 1 scan lines (GATE_N, GATE_N+1, GATE_N+2) and the type 2 scan lines (SHARING_N, SHARING_N+1, SHARING_N+2) are switched on in sequence, and a pulse width for every scan line is 10-20 μs. To satisfy proper effect of the multi-domain design and make the sub-pixels operate normally, the time that the type 2 scan line is switched on has to be later than the time that the type 1 scan line is switched on. However, in such a design, when the display utilizes reverse scan driving, the driving waveform diagram for the scan lines is shown in FIG. 6, the time that the type 2 scan line is switched on is earlier than the time that the type 1 scan line is switched on, as a result, the LCD with the multi-domain design fails to maintain the proper driving effect.

Therefore, it is necessary to provide an LCD and a driving method thereof to solve the problem existing in the current technique.

SUMMARY OF THE INVENTION

An objective of the present invention is to provide an LCD device and a driving method thereof, by which reverse scanning can be implemented without increasing cost, so as to solve the technical problem that the proper driving effect fails to be maintained when a current LCD device utilizes reverse scan driving.

The present invention designs an LCD device, wherein in comprises: a scan driving module for generating a first scan signal; a data driving module for generating a gray scale signal; pixels for displaying the gray scale signal according to the first scan signal, each pixel comprising at least two sub-pixels and pixel capacitors for re-assigning the gray scale signal of the sub-pixels; data lines connected with the data driving module and the pixels, respectively, each of which is used for controlling a charging voltage for the pixel according to the gray scale signal; shift register modules, each of which generates a second scan signal corresponding to the first scan signal based on the first scan signal; and scan lines, which includes type 1 scan lines connected to the scan driving module and the pixels, respectively, each of which is used for controlling a charging time for the pixel according to the first scan signal; and type 2 scan lines connected with the pixels, each of which is used for controlling a driving time for the sub-pixels of the pixel according to the second scan signal; the shift register module is connected with the type 1 scan line and the type 2 scan line, which corresponds to the type 1 scan line, respectively; the type 1 scan lines and the type 2 scan lines are mixedly arranged in turn, the type 1 scan line is separated from the corresponding type 2 scan line by A scan lines, wherein A is a positive integer greater than zero; the shift register module receives the first scan signal at time t, and the shift register module generates the second scan signal corresponding to the first scan signal at time t+T, wherein T is a predetermined delay time.

The present invention involves in an LED device, wherein it comprises: a scan driving module for generating a first scan signal; a data driving module for generating a gray scale signal; pixels for displaying the gray scale signal according to the first scan signal, each pixel comprising at least two sub-pixels and a pixel capacitor for re-assigning the gray scale signal of the sub-pixels; data lines connected with the data driving module and the pixels, respectively, each of which is used for controlling a charging voltage for the pixel according to the gray scale signal; shift register modules, each of which generates a second scan signal corresponding to the first scan signal based on the first scan signal; and scan lines, which includes type 1 scan lines connected to the scan driving module and the pixels, respectively, each of which is used for controlling a charging time for the pixel according to the first scan signal; and type 2 scan lines connected with the pixels, each of which is used for controlling a driving time for the sub-pixels of the pixel according to the second scan signal; the shift register module is connected with the type 1 scan line and the type 2 scan line, which corresponds to the type 1 scan line, respectively.

In the LCD device of the present invention, the type 1 scan lines and the type 2 scan lines are mixedly arranged in turn, the type 1 scan line is separated from the corresponding type 2 scan line by A scan lines, wherein A is a positive integer greater than zero.

In the LCD device of the present invention, the shift register module receives the first scan signal at time t, and the shift register module generates the second scan signal corresponding to the first scan signal at time t+T, wherein T is the predetermined delay time.

In the LCD device of the present invention, the shift register module is a single shift register, the shift register comprises a signal input pin, a clock input pin, an output pin and a feedback pin, the signal input pin is connected with the type 1 scan line, the output pin and the feedback pin are respectively connected with the type 2 scan line, the clock input pin is used for being inputted with the predetermined delay time T.

In the LCD device of the present invention, the shift register module comprises multiple shift registers connected in series and in sequence as multiple stages, each of the shift registers comprises a signal input pin, a clock input pin, and output pin and a feedback pin, the signal input pin is connected with the output pin of the previous-stage shift register, the output pin is connected with the signal input pin of the next-stage shift register and the feedback pin of the previous-stage shift register, respectively, the clock input pin for being inputted with the predetermined delay time; the signal input pin of the first-stage shift register is connected with the type 1 scan line, the output pine of the last-stage shift register is connected with the type 2 scan line and the feedback pin of the previous-stage shift register, respectively.

In the LCD device of the present invention, a pulse width of each of the first scan signal and the second scan signal is 10-20 μs.

The present invention also involves in an LCD device driving method, wherein the LCD device comprises: a scan driving module, shift register modules, and scan lines, which includes: a type 1 scan line for controlling a charging time for a pixel; a type 2 scan line for controlling a driving time for sub-pixels of the pixel; when the LCD device scans, the method comprises the steps of: S10, generating a first scan signal by the scan driving module to drive the type 1 scan line; S20, generating a second scan signal corresponding to the first scan signal by the shift register module based on the first scan signal; S30, driving the type 2 scan line corresponding to the type 1 scan line according to the second scan signal.

In the LCD device driving method of the present invention, the shift register module receives the first scan signal at time t, and the shift register module generates the second scan signal corresponding to the first scan signal at time t+T, wherein T is the predetermined delay time.

In the LCD device driving method of the present invention, the type 1 scan lines and the type 2 scan lines are mixedly arranged in turn, the type 1 scan line is separated from the corresponding type 2 scan line by A scan lines, wherein A is a positive integer greater than zero.

In the LCD device driving method of the present invention, the shift register module is a single shift register, the shift register comprises a signal input pin, a clock input pin, an output pin and a feedback pin, the signal input pin is connected with the type 1 scan line, the output pin and the feedback pin are respectively connected with the type 2 scan line, the clock input pin is used for being inputted with the predetermined delay time T.

In the LCD device driving method of the present invention, the shift register module comprises multiple shift registers connected in series and in sequence as multiple stages, each of the shift registers comprises a signal input pin, a clock input pin, and output pin and a feedback pin, the signal input pin is connected with the output pin of the previous-stage shift register, the output pin is connected with the signal input pin of the next-stage shift register and the feedback pin of the previous-stage shift register, respectively, the clock input pin for being inputted with the predetermined delay time; the signal input pin of the first-stage shift register is connected with the type 1 scan line, the output pine of the last-stage shift register is connected with the type 2 scan line and the feedback pin of the previous-stage shift register, respectively.

In the LCD device driving method of the present invention, a pulse width of each of the first scan signal and the second scan signal is 10-20 μs.

The LCD device and the driving method thereof can realize reverse scanning for any LCD device without increasing the cost of device, and thereby solving the technical problem that the current LCD device fails to maintain the proper driving effect when utilizing reverse scan driving.

The above contents of the present invention can be best understood by referring to the following detailed description of the preferred embodiments and the accompanying drawings.

DETAILED DESCRIPTION OF THE INVENTION

Figure 1:
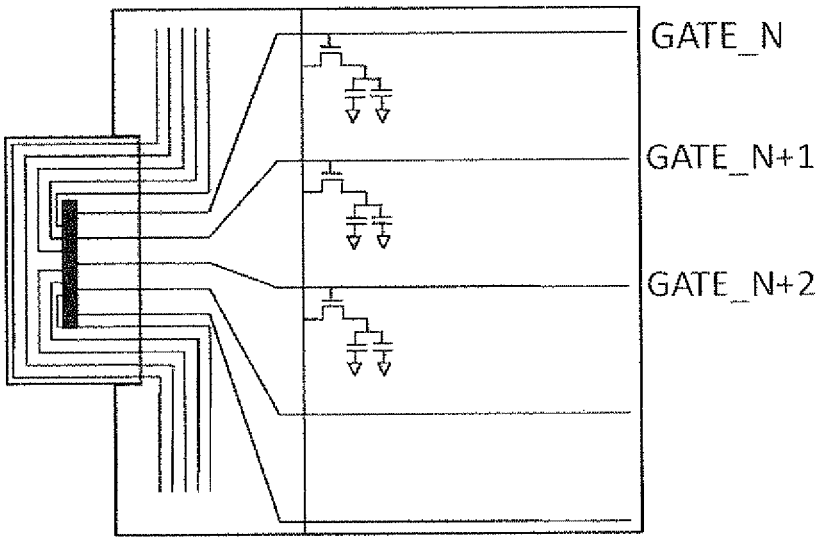
FIG. 1 (Prior Art)
FIG. 1 is a structure schematic diagram showing scan lines and pixels of a current LCD device.
Figure 2:
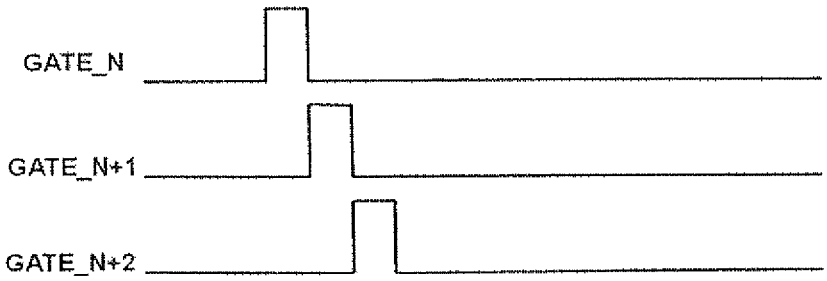
FIG. 2 (Prior Art)
FIG. 2 is a waveform diagram of driving signals for the scan lines shown in FIG. 1.
Figure 3:
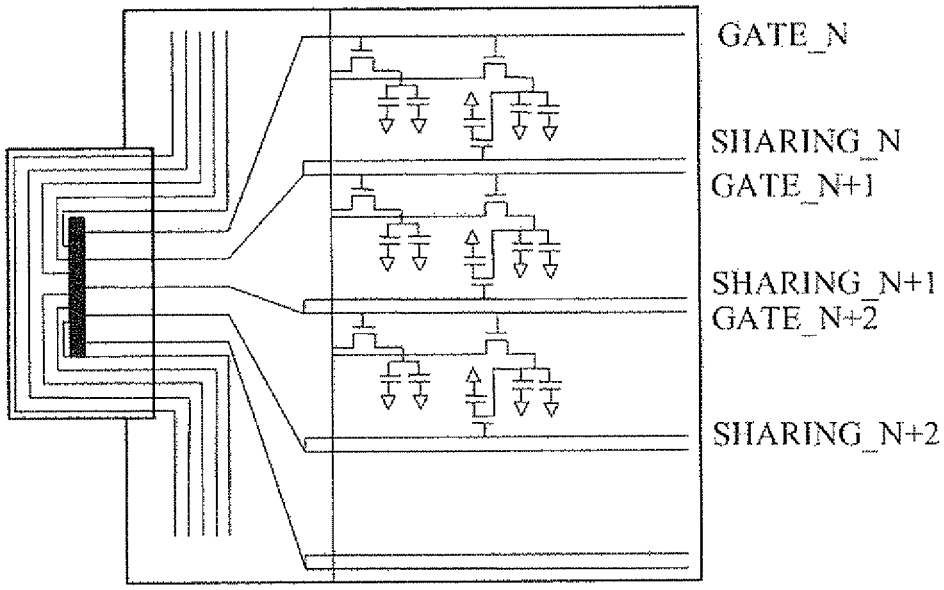
FIG. 3 (Prior Art)
FIG. 3 is one structure schematic diagram showing scan lines and pixels of a current multi-domain designed LCD device.
Figure 4:
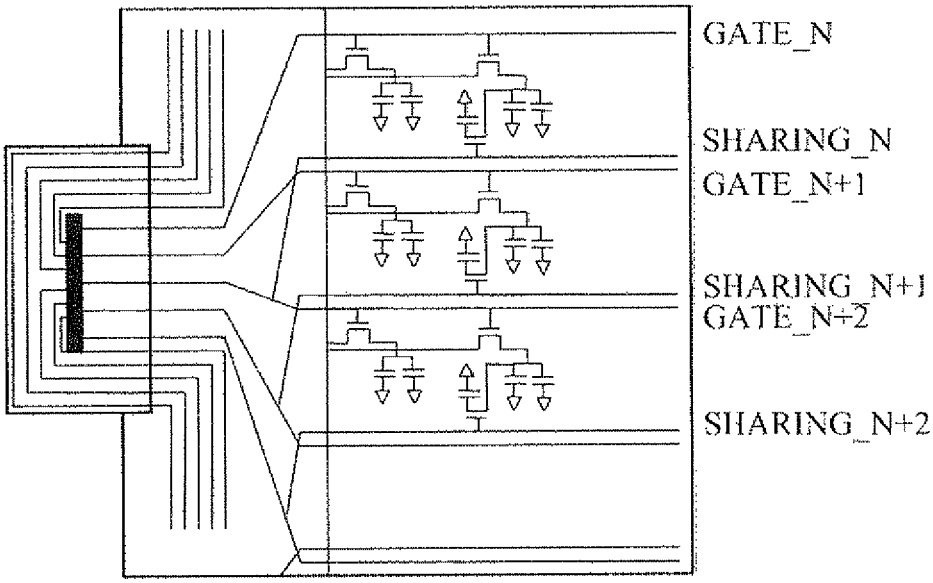
FIG. 4 (Prior Art)
FIG. 4 is another structure schematic diagram showing scan lines and pixels of a current multi-domain designed LCD device.
Figure 5:
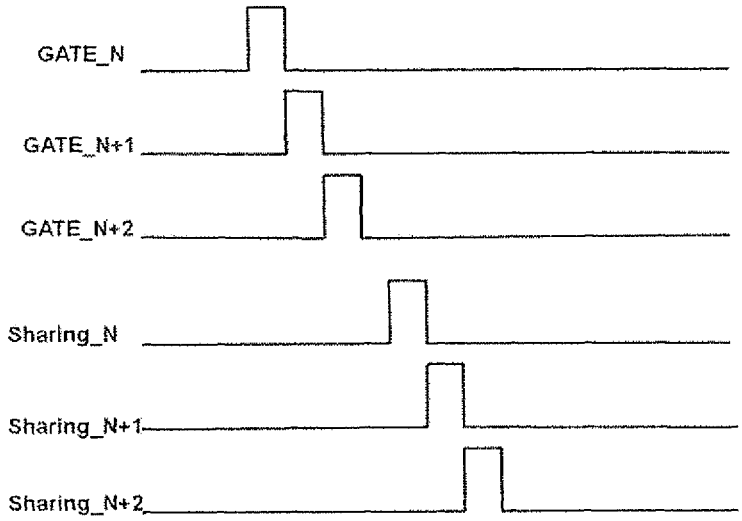
FIG. 5 (Prior Art)
FIG. 5 is a waveform diagram of driving signals for the scan lines of the current multi-domain designed LCD device.
Figure 6:
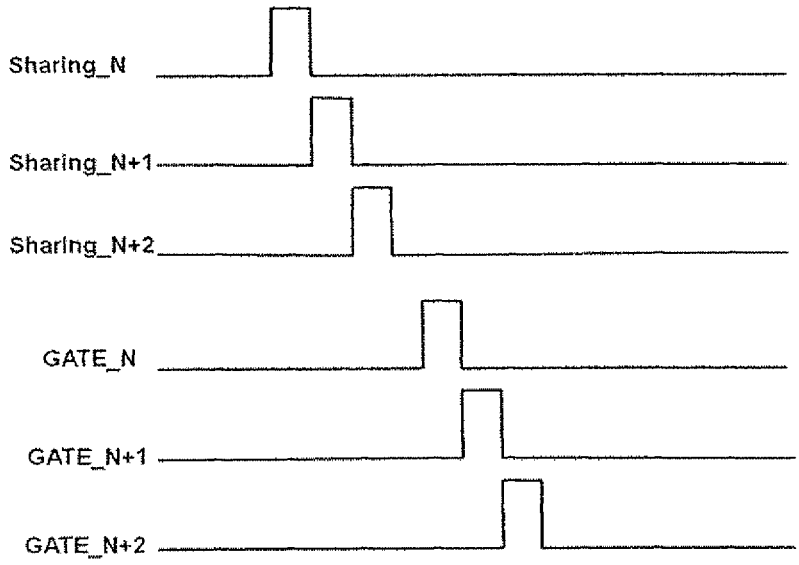
FIG. 6 is a waveform diagram of driving signals for the scan lines of the current multi-domain designed LCD device when reverse scanning is executed.

The following embodiments are referring to the accompanying drawings for exemplifying specific implementable embodiments of the present invention. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

In the drawings, structure-like elements are labeled with like reference numerals.

Figure 7:
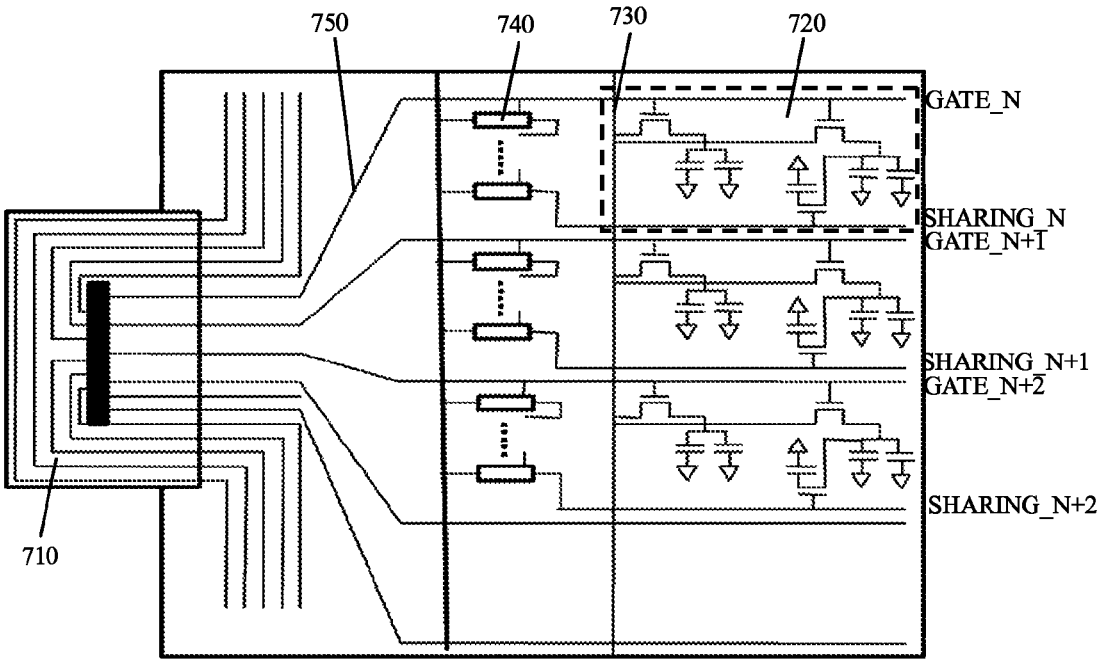
FIG. 7 is one structure schematic diagram showing scan lines and pixels of an LCD device of the present invention.

In FIG. 7, which shows a structure schematic diagram showing scan lines and pixels of an LCD device of the present invention, the LCD device comprises a scan driving module 710, a data driving module (not shown in the drawing), pixels 720, data lines 730, shift register modules 740 and scan lines 750. The scan driving module 710 is used for generating a first scan signal. The data driving module is used for generating a gray scale signal. The pixel 720 is used to display the gray scale signal according to the first scan signal, each pixel 720 comprises two sub-pixels and pixel capacitors for re-assigning the gray scale signal of the sub-pixels. The data line 730 is connected with the data driving module and the pixel 720, respectively, and is used for controlling a charging voltage for the pixel according to the gray scale signal. The shift register module 740 is used for generating a second scan signal, which corresponds to the first scan signal, based on the first scan signal (wherein a pulse width of each of the first scan signal and the second scan signal is preferably 10-20 μs). The scan lines 750 comprises type 1 scan lines (GATE_N, GATE_N+1, GATE_N+2) and type 2 scan lines (SHARING_N, SHARING_N+1, SHARING_N+2), the type 1 scan line is connected with the scan driving module 710 and the pixel 720, respectively, and is used for controlling a charging time of the pixel 720 according to the first scan signal; the type 2 scan line is connected with the shift register module 740 and the pixel 720, respectively, and is used for controlling a driving time of the sub-pixels of the pixel 720 according to the second scan signal. The type 1 scan line is connected with the corresponding type 2 scan line via the shift register module 740.

The LCD device of the present invention connects the type 1 scan line with the type 2 scan line corresponding to the type 1 scan line through the shift register module 740 (the type 2 scan line and the corresponding type 1 scan line are connected to the same pixel 720). When the LCD device of the present invention is in use, firstly, a predetermined delay time T is set in the shift register module 740, when the shift register module 740 receives the first scan signal for the type 1 scan line (e.g. GATE_N) (assumed at the time t), at the time, charging operation is executed to the pixel 720 by the type 1 scan line according to the first scan signal and the gray scale signal (wherein the charging time is controlled by the first scan signal, and the charging voltage is controlled by the gray scale signal); in the mean while, the shift register module 740 generates a second scan signal in correspondence to the first scan signal after delaying the predetermined delay time T (at the time t+T), and transmits the second scan signal to the type 2 scan line (e.g. SHARING_N) corresponding to the type 1 scan line, at this time, the type 2 scan line executes the driving operation to the sub-pixels according to the second scan signal and the pixel capacitors (wherein the driving time is controlled by the second scan signal, the amplitudes of the gray scale signal for different sub-pixels are controlled by the pixel capacitors), since the corresponding pixel 720 has accomplished the charging operation.

As can be known from the above, the second scan signal for the type 2 scan line is always later than the first scan signal for the type 1 scan line by the predetermined delay time T. Therefore, when the LCD device of the present invention utilizes reverse scanning, the time that the type 2 scan line is switched on can also be ensured to be later than the time that the corresponding type 1 scan line is switched on, in addition, a delayed interval can be adjusted by changing the predetermined delay time T, in this way, it is the same as forward scanning. In such a design, the LCD device of the present invention implements the reverse scanning function of the LCD device by merely adding the shift register module 740 to the current LCD device, and thereby increasing competitive strength of products.

Figure 8:
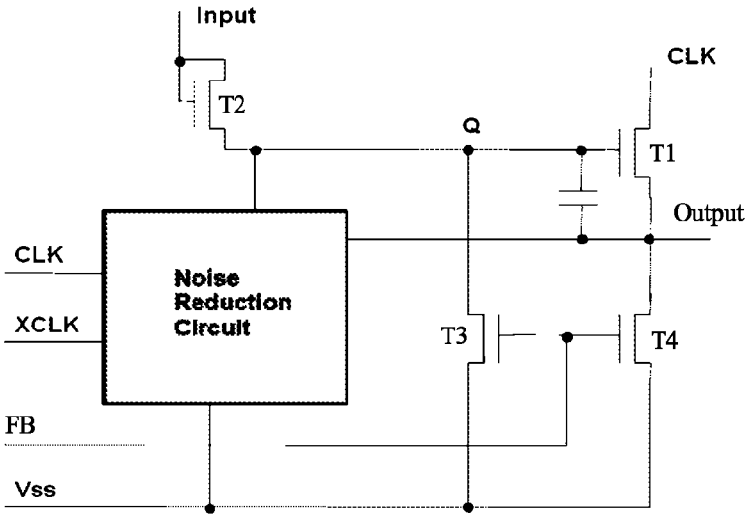
FIG. 8 is a structure schematic diagram showing a single shift register of an LCD device of the present invention.

In FIG. 8, which shows a structure schematic diagram showing a single shift register of an LCD device of the present invention, it can be seen from the drawing, the shift register module is a single shift register, the shift register comprises a signal input pin Input, a clock input pin CLK, an output pin Out and a feedback pin FB, wherein the signal input pin Input is connected with the type 1 scan line, the output pin Output and the feedback pin FB are respectively connected with the type 2 scan line, the clock input pin CLK is used to be inputted with the predetermined delay time T. When the shift register operates, the signal input pin Input receives the first scan signal of the type 1 scan line as a trigger, at this time, the signal input pin Input is at a high level, as a result, a level at a point Q is lifted to turn on T1, causing the output pin Output to output a CLK signal, at this time, CLK is low. When the first scan signal is off, the signal input pin Input is at a low level, so that T2 is turned off, however, the level at the point Q still remains high, at this time, CLK is high, and then the output pin Output outputs a high level as the second scan signal. In the mean while, the feedback pin FB receives the high level signal of the type 2 scan line after a certain delay to turn on T3 and T4, thereby pulling down the levels at the output pin Output and the point Q, and further switching off the outputting of the output pin Output, whereby an operation cycle of the shift register is completed.

Figure 9:
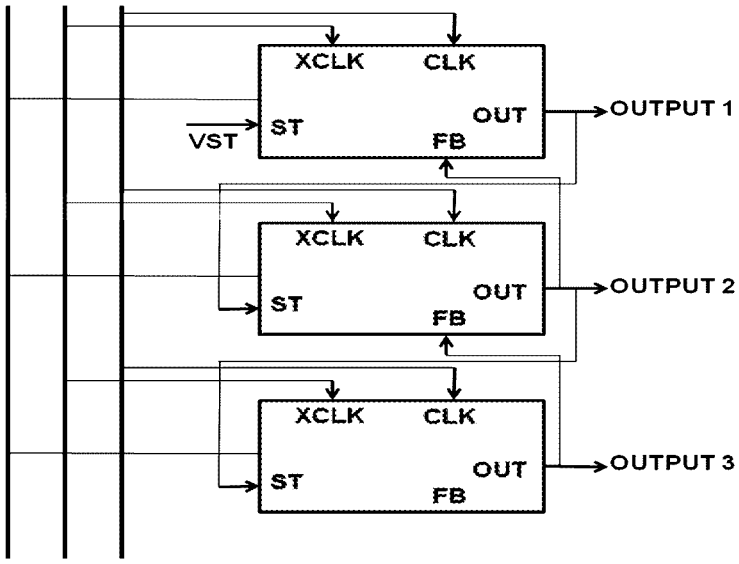
FIG. 9 is a connection schematic diagram showing multiple shift registers of an LCD device of the present invention.

In FIG. 9, which shows a connection schematic diagram showing multiple shift registers of an LCD device of the present invention, as can be seen for the drawing, the shift register module comprises multiple shift registers, which are connected in series as multiple stages, each of the shift register comprises a signal input pin ST, a clock input pin CLK, an output pin Out and a feedback pin FB, the signal input pin ST is connected with the output pin Out of the previous-stage shift register, the output pin Out is connected with the signal input pin of the next-stage shift register and the feedback pin FB of the previous-stage shift register, respectively, the clock input pin CLK is used to be inputted with the predetermined delay time T; the signal input pin ST of the first-stage shift register is connected with the type 1 scan line, and the output pin Out of the last-stage shift register is connected with the type 2 scan line and the feedback pin FB of the previous-stage shift register, respectively. The predetermined delay time T can be adjusted better and more accurately by utilizing the multiple shift registers connected in series as multiple stages. An individual one of the shift registers follows the same operation principle as described above.

Figure 10:
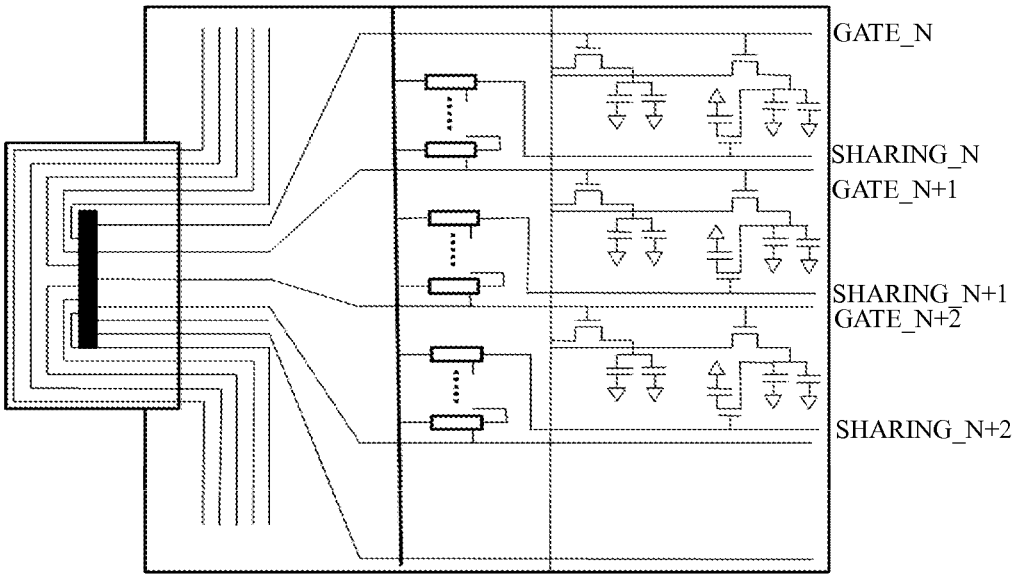
FIG. 10 is another structure schematic diagram showing scan lines and pixels of the LCD device of the present invention.

As a preferred embodiment of the LCD device of the present invention, in FIG. 10, which shows a structure schematic diagram showing scan lines and pixels of the LCD device of the present invention, the type 1 scan lines (GATE_N, GATE_N+1, GATE_N+2) and the type 2 scan lines (SHARING_N, SHARING_N+1, SHARING_N+2) are mixedly arranged in turn, the type 1 scan line is separated from the corresponding type 2 scan line by A scan lines, wherein A is a positive integer greater than 0, A is 2 in FIG. 10, but A can also be any other positive integer greater than 0, of course. The LCD device of the present invention can be implemented by modifying any current multi-domain designed LCD device, it is only necessary to connect the type 1 scan line and the corresponding type 2 scan line by using the shift register module.

The present invention further involves in an LCD device driving method, in which the LCD device comprises: a scan driving module, shift register modules and scan lines, which include: type 1 scan lines, each of which is used for controlling charging time for a pixel; and type 2 scan lines, each of which for controlling driving time for sub-pixels of the pixel. When the LCD device executes scanning, the method comprises the steps of: S10, generating a first scan signal to drive the type 1 scan line by the scan driving module; S20, generating a second scan signal corresponding to the first scan signal by the shift register module based on the first scan signal; S30, driving the type 2 scan line corresponding to the type 1 scan line according to the second scan signal.

Amongst, the shift register module receives the first scan line at time t, and the shift register module generates the second scan signal corresponding to the first scan signal at time t+T, wherein T is a predetermined delay time.

In the LCD device driving method of the present invention, the second scan signal for the type 2 scan line can be constantly postponed with respect to the corresponding first scan signal by the time T, and therefore the normal displaying performance of the LCD device as in the same manner that the LCD device executes the forward driving is ensured, that is, the second scan signal will not be activated earlier than the corresponding first scan signal.

In conclusion, while the preferred embodiments of the present invention have been illustrated and described in detail, the embodiment of the present invention is therefore described in an illustrative but not restrictive sense, various modifications and alterations can be made by persons skilled in this art without departing from the spirit and realm of the present invention, and therefore the protection range of the present invention depends on the scope as defined in the appended claims.

What is claimed is:

1. A liquid crystal display device, characterized in that: comprising:

a scan driving module for generating a first scan signal;

a data driving module for generating a gray scale signal;

pixels, each of which displays the gray scale signal according to the first scan signal, each pixel comprising at least two sub-pixels and pixel capacitors for re-assigning the gray scale signal to the sub-pixels;

data lines connected with the data driving module and the pixels, respectively, each of the data lines controlling a charging voltage for the pixel according to the gray scale signal;

shift register modules, each of which generates a second scan signal corresponding to one of the first scan signal based on the first scan signal; and scan lines including:

type 1 scan lines connected with the scan driving module and the pixels, respectively, each of the type 1 scan lines controlling charging time for the pixel according to the first scan signal; and type 2 scan lines connected to the pixels, each of the type 2 scan lines controlling driving time for the sub-pixels of the pixel according to the second scan signal;

the shift register module is connected with the type 1 scan line and the type 2 scan line corresponding to the type 1 scan line, respectively;

the type 1 scan lines and the type 2 scan lines are mixedly arranged in turn, the type 1 scan line is separated from the corresponding type 2 scan line by A scan lines, wherein A is a positive integer greater than 0;

the shift register modules receives the first scan signal at time t, the shift register modules generates the second scan signal corresponding to the first scan signal at time t+T, wherein T is a predetermined delay time;

the shift register module is a single shift register, the shift register comprises a signal input pin, a clock input pin, an output pin and a feedback pin, the signal input pin is connected with the type 1 scan line, the output pin and the feedback pin are respectively connected with the type 2 scan line, the dock input pin is used for being inputted with the predetermined delay time T.

2. A liquid crystal display device, characterized in that: comprising:

a scan driving module for generating a first scan signal;

a data driving module for generating a gray scale signal;

pixels, each of which displays the gray scale signal according to the first scan signal, each pixel comprising at least two sub-pixels and pixel capacitors for re-assigning the gray scale signal to the sub-pixels;

data lines connected with the data driving module and the pixels, respectively, each of the data lines controlling a charging voltage for the pixel according to the gray scale signal;

shift register modules, each of which generates a second scan signal corresponding to one of the first scan signal based on the first scan signal; and scan lines including:

type 1 scan lines connected with the scan driving module and the pixels, respectively, each of the type 1 scan lines controlling charging time for the pixel according to the first scan signal; and type 2 scan lines connected to the pixels, each of the type 2 scan lines controlling driving time for the sub-pixels of the pixel according to the second scan signal;

the shift register module is connected with the type 1 scan line and the type 2 scan line corresponding to the type 1 scan line, respectively;

the shift register module receives the first scan signal at time t, the shift register module generates the second scan signal corresponding to the first scan signal at time t+T, wherein T is a predetermined delay time;

the shift register module comprises a plurality of shift registers connected in series as multiple stages, each of the shift registers comprises a signal input pin, a clock input pin, an output pin and a feedback pin, the signal input pin is connected with the output pin of a previous-stage shift register, the output pin is connected with the signal input pin of a next-stage shift register and the feedback pin of the previous-stage shift register, respectively, the clock input pin is used for being inputted with the predetermined delay time T;

the signal input pin of a first-stage shift register is connected with the type 1 scan line, the output pint of a last shift register is connected with the type 2 scan line and the feedback pin of the previous-stage shift register, respectively.

3. The liquid crystal display device according to claim 2, characterized in that the type 1 scan lines and the type 2 scan lines are mixedly arranged in turn, the type 1 scan line is separated from the corresponding type 2 scan line by A scan lines, wherein A is a positive integer greater than 0.

4. The liquid crystal display device according to claim 2, characterized in that a pulse width of each of the first scan signal and the second scan signal is 10-20 μs.

5. A liquid crystal display device driving method, characterized in that, the liquid crystal display device comprises:

a scan driving module, shift register modules, and scan lines comprising:

type 1 scan lines, each controlling charging time for a pixel;

type 2 scan line, each controlling driving time for sub-pixels of the pixel;

when the liquid crystal display executes scanning, the method comprising steps of:

S10, generating a first scan signal for driving one of the type 1 scan lines by the scan driving module;

S20, generating a second scan signal corresponding to the first scan signal by the shift register module based on the first scan signal;

S30, driving the type 2 scan line corresponding to the type 1 scan line according to the second scan signal;

the shift register module receives the first scan signal at time t, the shift register module generates the second scan signal corresponding to the first scan signal at time t+T, wherein T is a predetermined delay time;

the shift register module comprises a plurality of shift registers connected in series as multiple stages, each of the shift registers comprises a signal input pin, a clock input pin, an output pin and a feedback pin, the signal input pin is connected with the output pin of a previous-stage shift register, the output pin is connected with the signal input pin of a next-stage shift register and the feedback pin of the previous-stage shift register, respectively, the clock input pin is used for being inputted with the predetermined delay time T;

the signal input pin of a first-stage shift register is connected with the type scan line, the output pint of a last shift register is connected with the type 2 scan line and the feedback pin of the previous-stage shift register, respectively.

6. The liquid crystal display device driving method according to claim 5, characterized in that the type 1 scan lines and the type 2 scan lines are mixedly arranged in turn, the type 1 scan line is separated from the corresponding type 2 scan line by A scan lines, wherein A is a positive integer greater than 0.

7. The liquid crystal display device driving method according to claim 5, characterized in that a pulse width of each of the first scan signal and the second scan signal is 10-20 μs.

* * * * *